United States Patent [19]

Gaurois

[11] 4,042,651

[45] Aug. 16, 1977

[54] SUPPORTING FRAMEWORK FOR HEAT TRANSFER SURFACES FOR COOLING TOWER

[75] Inventor: Raphael Emile Gaurois, Brussels, Belgium

[73] Assignee: Hamon Sobelco S.A., Belgium

[21] Appl. No.: 689,835

[22] Filed: May 25, 1976

[30] Foreign Application Priority Data

May 28, 1975 Luxembourg ..... 72596

[51] Int. Cl.[2] ..... B01F 3/04

[52] U.S. Cl. ..... 261/111; 52/403; 52/637; 261/DIG. 11

[58] Field of Search ..... 261/111, 112, DIG. 11, 261/DIG. 77; 52/403, 637, 638, 645, 646, 684

[56] References Cited

U.S. PATENT DOCUMENTS

| | | | |
|---|---|---|---|
| 1,864,898 | 6/1932 | Fleming | 261/DIG. 11 |
| 2,294,240 | 8/1942 | Pollman | 52/637 X |
| 2,612,025 | 9/1952 | Hunsucker | 52/637 X |
| 3,396,501 | 8/1968 | Tate | 52/403 X |
| 3,870,773 | 3/1975 | Luzaich | 261/DIG. 11 |
| 3,899,857 | 8/1975 | Mochizuki | 52/403 X |
| 3,918,229 | 11/1975 | Schweinberger | 52/403 X |

*Primary Examiner*—Tim R. Miles
*Assistant Examiner*—Richard L. Chiesa
*Attorney, Agent, or Firm*—Harold L. Stowell

[57] ABSTRACT

A supporting framework for heat exchange surfaces for atmospheric cooling towers includes a plurality of primary generally vertically directed support members hingedly interconnected and further support members connected to the primary support members via elastic members having a high modulus of compression and a low modulus of elasticity relative to the elements forming the framework.

9 Claims, 11 Drawing Figures

SUPPORTING FRAMEWORK FOR HEAT TRANSFER SURFACES FOR COOLING TOWER

BACKGROUND OF THE INVENTION

Natural draft, fan-assisted natural draft and forced draft cooling towers are well known and commonly employed to withdraw waste heat from industrial plants and in particular to withdraw waste heat from condenser cooling liquid exhausting from steam and the like condensable fluid turbine driven power generating stations.

A number of different types of fan-assisted natural draft and natural draft cooling towers have been designed, constructed and used. In one common form, the filling or heat transfer sections are mounted within the chimney portion of the tower assembly on supporting framework. Above the filling or heat exchange sections are mounted a network or grid of liquid distribution pipes which direct the liquid to be cooled to the external surface of the filling. Below the filling and in the lower side walls of the tower are inlet openings for atmospheric air and the base of the tower comprises a sump for collection of the air-cooled liquid. Such assemblies may also include droplet or mist eliminators which are mounted above the network of liquid distribution pipes.

In such cooling towers, a liquid, generally water, comes into direct contact with an upward flow of atmospheric air in heat exchange relation with the water trickling over the outer surfaces of the fill. The fill generally comprises a series of even or corrugated plates or sheets, or of gratings of various forms.

Natural draft cooling towers of the type described above may be as high as from about 300 to 500 feet and the supporting framework for the fill for such a tower may have a height of from about 50 to 65 feet. Thus, the supporting framework for the heat exchange fill is sensitive to seismic movements and means must be taken into account when designing such structures to reduce to a minimum the adverse effects of potential seismic movements.

GENERAL DESCRIPTION OF THE PRESENT INVENTION

The present invention is generally directed to improved supporting framework for heat exchange surfaces for atmospheric cooling towers which will minimize the adverse effects of seismic movements and the invention may be generally defined as supporting framework for heat exchange surfaces for atmospheric cooling towers including a plurality of primary generally vertically directed support members hingedly interconnected and further support members connected to the primary support members via elastic members having a high modulus of compression and a low modulus of elasticity relative to the elements forming the framework.

DETAILED DESCRIPTION OF THE DRAWINGS AND DETAILED DESCRIPTION OF THE PREFERRED EMBODIMENTS

Figure 1:
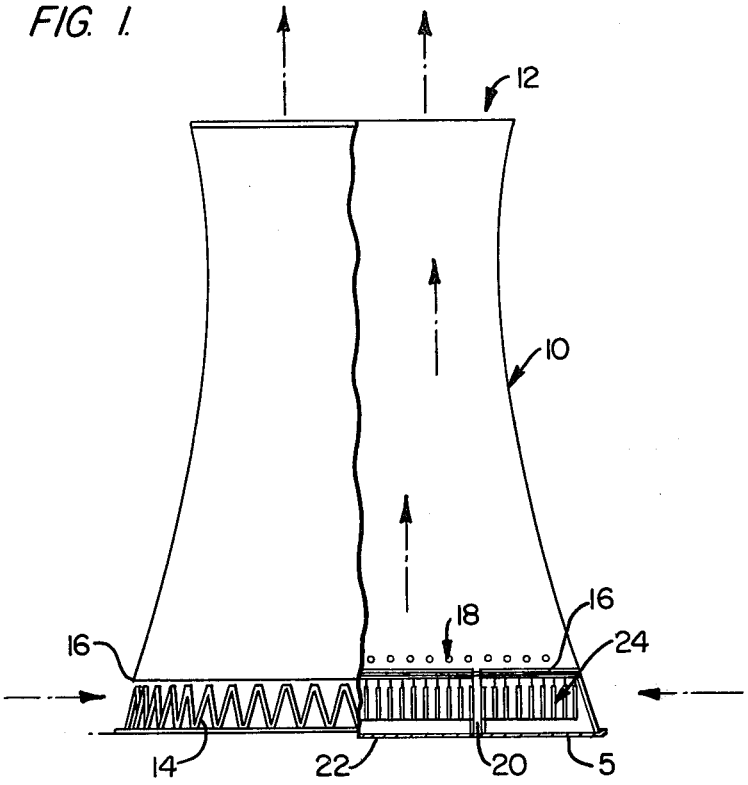
FIG. 1 is an elevational view partially in section of a countercurrent natural-draft cooling tower.

Referring to FIG. 1, 10 designates a countercurrent natural-draft type cooling tower having an upper air outlet end 12 and about the lower end are openings 14 for the inward flow of cooling air which passes through the tower in the direction of the directional arrows.

The cooling air in passing through the tower flows in countercurrent relationship to a downward flow of liquids, such as water exhausting from the condensers of a steam driven turbine for an electric power producing system. The water is distributed to conventional filling generally designated 16 from a network of distribution pipes 18 which are fed by a number of riser pipes 20 connected to the exhaust from the condenser or the like (not shown).

The conventional filling 16 is supported from the base 22 of the tower via a supporting framework generally designated 24. Below the fill 16 is a sump 5 which collects the water or the like liquid falling from the fill. The liquid in the sump 5 is then pumped to the inlet of the turbine condenser via suitable pumps and piping (not shown).

Figure 2:
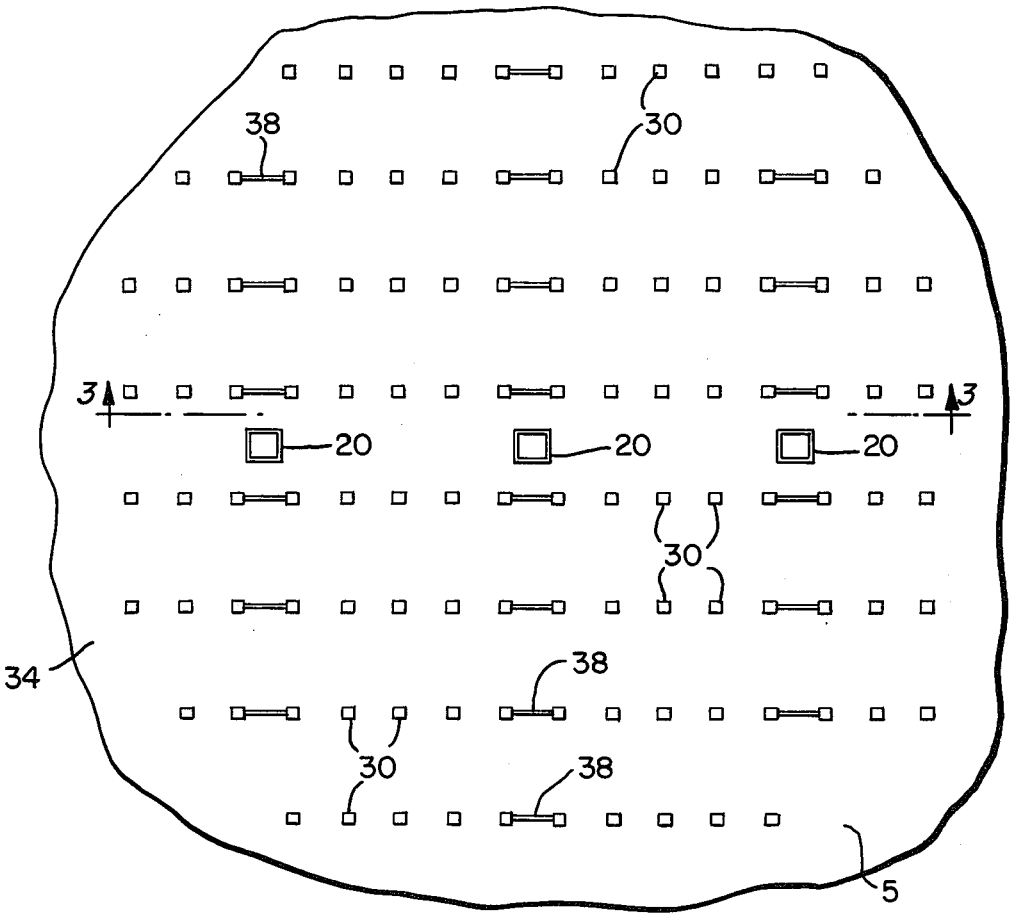
FIG. 2 is a horizontal sectional view through selected portions of the supporting framework for heat exchange fill for an atmospheric cooling tower of the prior art.
Figure 3:
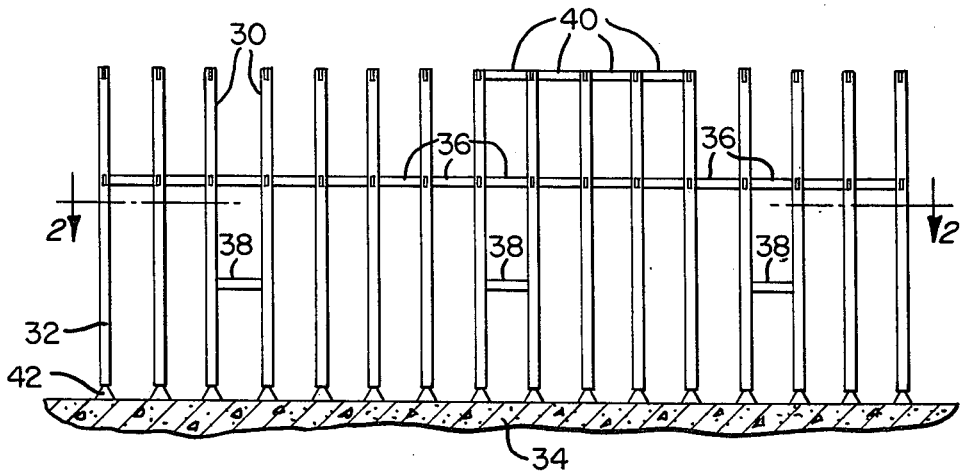
FIG. 3 is a diagrammatic view on line 3—3 of FIG. 2.

Referring now to FIGS. 2 and 3, which illustrate schematically selected elements of conventional framework 24 for supporting the conventional fill 16, the conventional support means 24 comprises a plurality of generally vertical columns 30 which rests at their lower ends 32 on the tower foundation 34. The plurality of vertical columns may be interconnected through a series of horizontal girders 36 and 38 and each of the vertical columns 30 is interconnected at the top via girders 40 which lie in two perpendicular directions. The girders 40 form the lower supports for the filling sheets.

The columns 30 and the interlinking girders 36, 38 and 40 and the fill sheets may be independent of the peripheral wall of the tower 10 or such elements may be connected to the vertical wall at several points.

The vertical columns 30 may have their bases in fixed relationships to the foundation 34 or the columns may be provided with a hinge connection as illustrated diagrammatically at 42. The linking beams or girders 36, 38 and the top linking girders 40 may be rigid with the columns 30 or be connected thereto through articulate means. When the linking means between the girders and the columns and the columns and the foundation 34 are articulate, the framework is unstable and is stablized or steadied by suitable means which might comprise rigid connections between the vertical columns 30 and interlinking beams 38.

Framework of the above-described type are particularly susceptible to horizontal acceleration of the supporting earth caused by seismic movement. For example, a horizontal acceleration of 1g at the ground produces an acceleration equal to 2.5g at the level of the fill supported by girders 40. In order to account for such movement, the cross dimension of the vertical columns, the number of columns and the nature of the means interconnecting the columns with the cross-girders must be sufficiently great to account for such seismic effects thereby materially increasing the cost of construction of the framework.

Through the teachings of the present invention, the cost of the framework for supporting cooling tower fill is materially reduced by a framework in which the transmission of seismic strain is considerably minimized.

The improved framework according to the teachings of the present invention is characterized in that it comprises elastic supports interlinking several of the members of the supporting framework with rigid or stationary bearings and further being characterized in that the elastic supports are positioned to act primarily in shear and the supports are selected to have a high modulus of compression and a reduced modulus of elasticity compared to the modulus of compression and modulus of elasticity of the material forming the primary elements of the supporting framework.

Further, the framework, according to the present invention, has no rigid link between the ground and the vertical columns thereof and the size of the elastic interlinking supports is chosen so as to situate the natural frequency of the combination of framework and elastic support elements in a range producing only reduced horizontal and vertical resultant acceleration.

Further, in carrying out the present invention, the stationary elements having the elastic connections to the supporting framework may be chosen from normally rigid elements of the cooling tower, the ground of foundation of the tower or such rigid supports may be constituted by shape-conserving support devices connected to the ground through articulated links, and in sufficient number and arrangement to provide support in two perpendicular directions. The elastic elements interconnecting the support devices and the supporting framework may be formed of natural rubber, synthetic elastomeric materials or metallic springs or combinations thereof as will be more apparent hereinafter.

Figure 4:
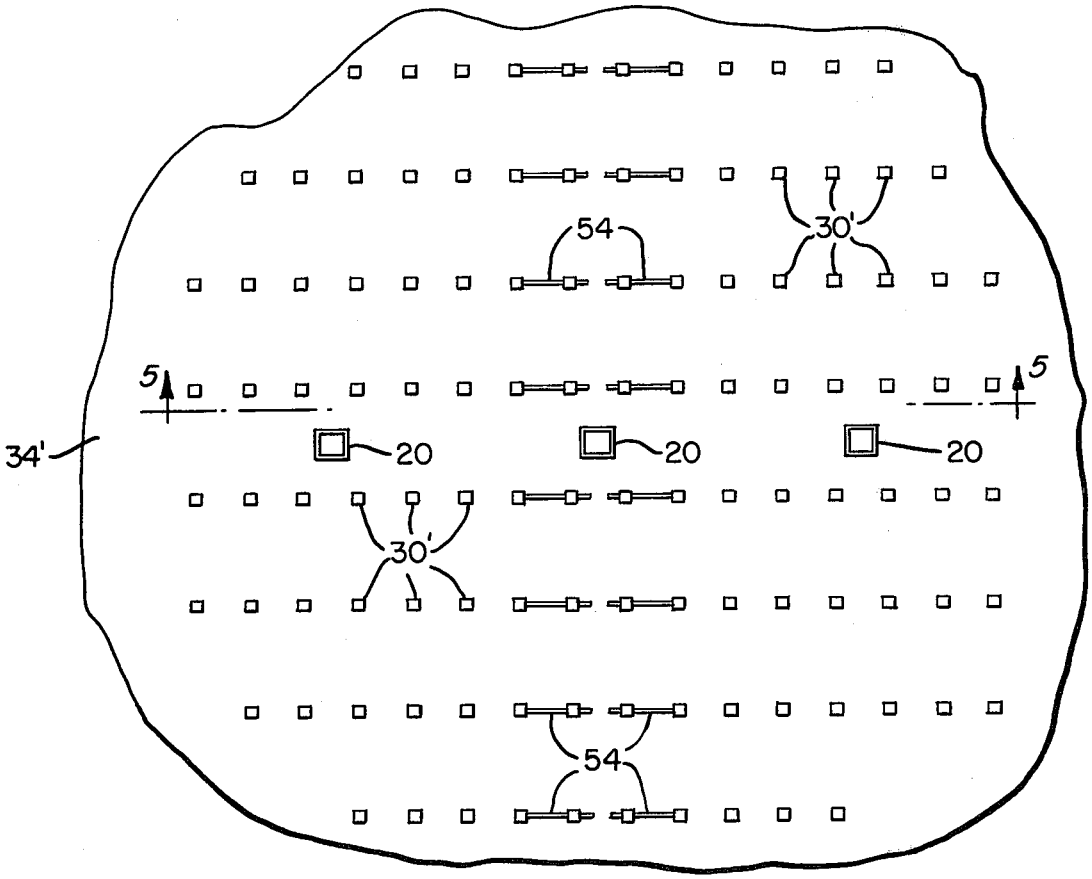
FIG. 4 is a view like FIG. 2 of selected portions of the framework embodying the principles of the present invention.
Figure 5:
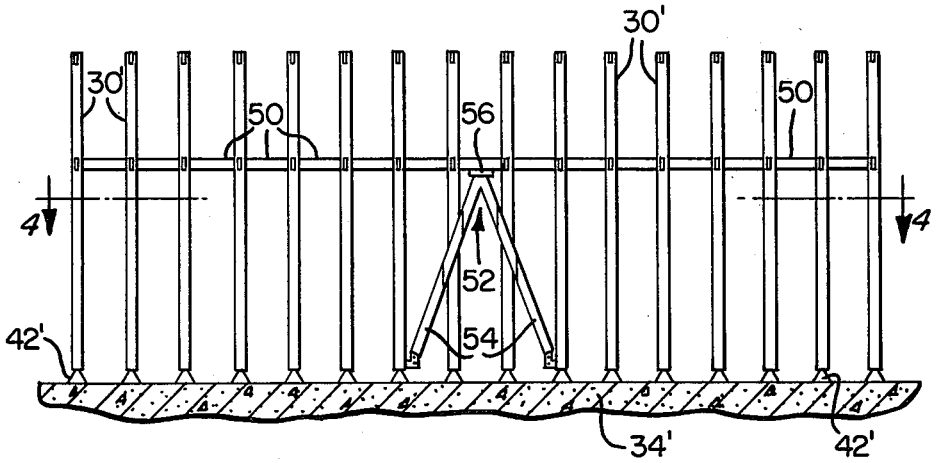
FIG. 5 is a diagrammatic view on line 5—5 of FIG. 4.

A first embodiment of a framework of the invention is shown in FIGS. 4 and 5. FIG. 4 is a sectional view taken along line 4—4 of FIG. 5, and the FIG. 5 is an elevational view taken along line 5—5 of FIG. 4. The columns 30' each take their bearing upon a hinged connection 42', and the interlinking girders 50 are mounted thereto through hinged connectors. The entire articulated set of columns and girders is semi-rigidly fastened to the foundations 34' through a series of pedestals 52, formed by two struts 54 bearing, in the same manner as the columns 30', upon hinged connection with the foundation 34'.

In this embodiment, the pedestals are indeformable devices which, resting upon the ground, constitute the stationary supports for the framework. One or more pedestals 52 are provided for each row of columns 30' in two perpendicular directions.

FIG. 4 shows the pedestals 52 for one pair of columns 30' and along one direction only.

According to this embodiment, the pedestals 52 each carry at their upper ends an elastic support 56, arranged so that the forces directed thereto act through shearing, in their connection to an interlinking girder 50 and the foundation 34'. The elastic support 56 is of the type having a high modulus of compression and a reduced modulus of elasticity, compared to those of concrete and steel. These elastic supports, thus, allow relative movement between the interlinking girders 50 and the stationary bearing when placed under horizontal strains, thus reducing notably the transmission of the horizontal strains to the girders and the interior framework of the tower.

Figure 6:
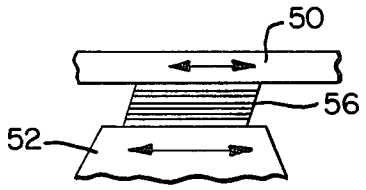
FIG. 6 is an enlarged diagrammatic illustration of a form of elastic support means for the fill supporting framework illustrated in FIGS. 4 and 5.

FIG. 6 illustrates diagrammatically the movement of the interior framework relative to the ground. It has been observed that, for a horizontal acceleration of 1g of the ground, the acceleration transmitted to the fill supporting framework constructed according to the invention is only 0.7 to 0.8 g at the filling level, against 2.5g for prior art structures of this general type. Thus, it becomes possible to reduce the dimensions of the elements of the inventive framework. For example, the columns 30 the size of which are 35 × 35 cm in the framework shown by FIGS. 2 and 3, can be reduced to a size of 30 × 30 cm in the embodiment according to the invention.

Figure 7:
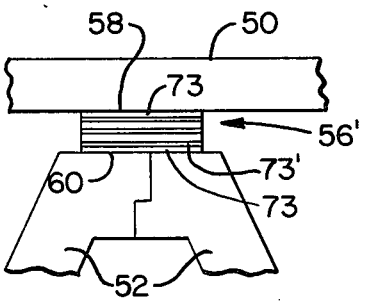
FIG. 7 is an enlarged diagrammatic view of a modified form of elastic support member of the present invention.
Figure 8:
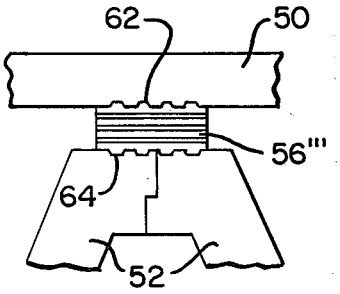
FIG. 8 is a view like FIG. 7 of a further form of the present invention.

The elastic supports 56 may have various forms and FIGS. 7 and 8 illustrate two of these by way of example. The elastic support 56' of FIG. 7 comprises a multi-layered rubber or elastomer bodies 73 laminated with metallic plates 73' with smooth bearing surfaces (58 and 60), glued, for example, with an epoxy resin respectively onto pedestal 52 and the interlinking girder 50.

The elastic body 56" of FIG. 8 presents corrugated contact surfaces (62 and 64). Such arrangement permits limiting or omitting completely the use of glue at the surface of contact.

Figure 9:
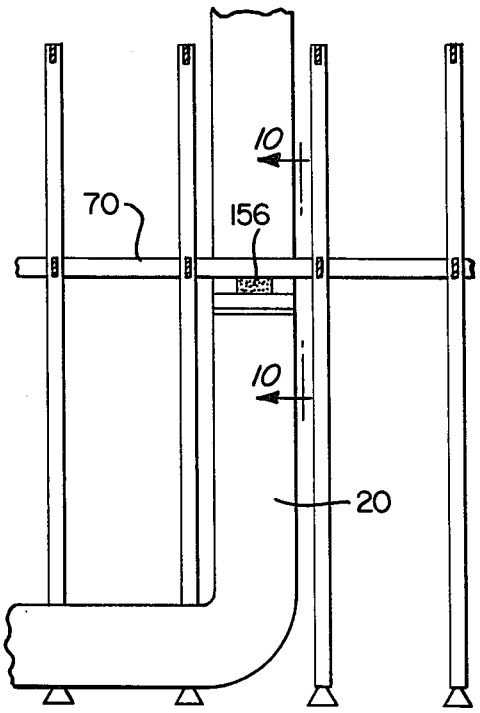
FIG. 9 is a diagrammatic view schematically illustrating another form of elastic support means for framework constructed in accordance with the present invention.
Figure 10:
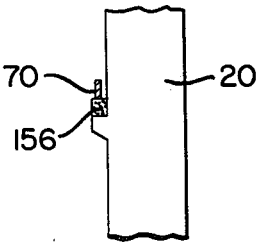
FIG. 10 is a section on line 10—10 of FIG. 9.

FIGS. 9 and 10 show another embodiment of the invention, in which the elastic connection between the primary framework and rigid members is realized between the interlinking girders 70 and the water uptake pipes 20, which may be six in number in any given tower. Each system of girders 70 is connected through an elastic link 156 to each pipe 20. FIGS. 9 and 10 illustrate one only of said elastic links. In general, the number of the water uptake pipes 20 is insufficient to realize the full benefit of the invention and such bearings 156 only replace a fraction of the supports in the form of the hereinbefore described pedestals.

Figure 11:
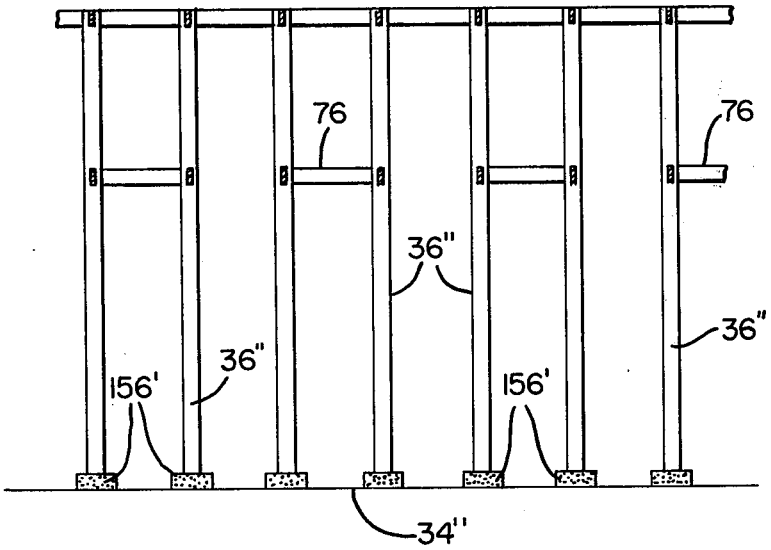
FIG. 11 is a diagrammatic view of the selected elements of a further embodiment of the present invention.

FIG. 11 shows a further embodiment according to the invention, wherein each of the columns 36" is mounted on elastic bearings 156' replacing the hinged (articulate) bearings 42–42' of the previously described embodiments. In this embodiment, the foundation 34" itself constitutes the stationary bearing for the framework. This assembly is rendered stable through girders 76, interlinking the columns 36" in groups of four, forming a four-sided assembly constituting rigid gantries. The elastic bearings may be of the type shown and described in reference to FIGS. 7 and 8.

Throughout the specification and claims the words "elastic bearing element" are intended to include natural or synthetic elastomeric compositions, metal springs or combinations thereof. And the word "shearing" is intended to mean "an action of stress resulting from applied forces which causes or tends to cause two contiguous parts to slide relatively to each other in a direction parallel to their plane of contact."

I claim:

1. An atmospheric cooling tower assembly comprising:

a foundation, an upwardly extending peripheral wall defining a tower structure supported by said foundation, said wall having an air inlet opening adjacent its lower end communicating with an open upper end for the flow of atmospheric air through the tower structure, a sump at the lower end of the tower structure below the air inlet opening, liquid distribution pipes in said tower structure between the upper end of the air inlet and the open upper end of the tower structure, cooling tower fill comprising heat exchange surfaces positioned below the liquid distribution pipes, supporting framework for said heat exchange surfaces, said supporting framework comprising a plurality of primary generally vertically directed support members extending upwardly from said sump, means hingedly interconnecting the said plurality of primary support members, further support members having stationary bearings, means connecting the said further support members to said primary support members via elastic members having a high modulus of compression and a low modulus of elasticity relative to the primary support members and said further support members forming the supporting framework.

2. The framework according to claim 1, characterized in that said stationary bearings are formed by rigid parts of the cooling tower.

3. The framework according to claim 1, characterized in that said stationary bearings are formed by said foundation of the cooling tower.

4. The framework according to claim 1, characterized in that said further support members are formed by undeformable supporting devices, connected with the ground through hinged links, said supporting devices being arranged in two perpendicular directions.

5. The framework according to claim 4, characterized in that each undeformable supporting device comprises pedestals formed by two inclined struts, the lower ends of which are hinged and the upper ends interlinked, the upper part of each pedestal carrying one of said elastic supports and one element of the framework 6. The framework according to claim 1, characterized in that each elastic support consists of natural or synthetic resilient material.

7. The framework according to claim 1, characterized in that each elastic support comprises a multi-layered laminated body, formed by metallic plates bedded in an elastomeric material.

8. The framework according to claim 1, characterized in that the bearing surfaces of the elastic supports are smooth.

9. The framework according to claim 1, characterized in that the bearing surfaces of the elastic supports are non-planar to reduce horizontal slipping.

* * * * *